US009998840B2

(12) United States Patent
Muza

(10) Patent No.: US 9,998,840 B2
(45) Date of Patent: Jun. 12, 2018

(54) SYSTEM AND METHOD FOR ALL ELECTRICAL NOISE TESTING OF MEMS MICROPHONES IN PRODUCTION

(71) Applicant: Robert Bosch GmbH, Stuttgart (DE)

(72) Inventor: John Matthew Muza, Venetia, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days. days.

(21) Appl. No.: 15/114,458

(22) PCT Filed: Feb. 24, 2015

(86) PCT No.: PCT/US2015/017318
§ 371 (c)(1),
(2) Date: Jul. 27, 2016

(87) PCT Pub. No.: WO2015/142486
PCT Pub. Date: Sep. 24, 2015

(65) Prior Publication Data

US 2017/0048634 A1 Feb. 16, 2017

Related U.S. Application Data

(60) Provisional application No. 61/954,284, filed on Mar. 17, 2014.

(51) Int. Cl.
*H04R 3/00* (2006.01)
*H04R 29/00* (2006.01)
(Continued)

(52) U.S. Cl.
CPC ..... *H04R 29/004* (2013.01); *H04R 3/06* (2013.01); *H04R 29/005* (2013.01);
(Continued)

(58) Field of Classification Search
CPC . H04R 3/005; H04R 2410/01; G10L 21/0216; G10L 21/02
(Continued)

(56) References Cited

U.S. PATENT DOCUMENTS

2006/0093172 A1* 5/2006 Ludvigsen ..... H04R 25/552 381/315
2008/0192962 A1* 8/2008 Halteren ..... H04R 1/222 381/170
2013/0121505 A1* 5/2013 Duraiswami ..... H04R 3/005 381/92

OTHER PUBLICATIONS

International Search Report and Written Opinion for Application No. PCT/US2015/015133 dated Jun. 4, 2015 (15 pages).
(Continued)

*Primary Examiner* — Alexander Jamal
(74) *Attorney, Agent, or Firm* — Michael Best & Friedrich LLP

(57) ABSTRACT

Systems and methods for electrical testing of noise in a multi-membrane micro-electro-mechanical systems (MEMS) microphone are disclosed. The MEMS system has a test mode that includes placing the microphones' MEMS biasing networks into a reset mode, adjusting the first bias voltage for the first MEMS sensor such that a polarity matches the polarity of the bias voltage of the second MEMS sensor. The MEMS biasing networks are then placed into a sense mode, and a total noise value is obtained for the MEMS microphone system by measurement of the output of the system's preamplifier.

11 Claims, 3 Drawing Sheets

(51) Int. Cl.
*H04R 3/06* (2006.01)
*H04R 19/00* (2006.01)

(52) U.S. Cl.
CPC ..... *H04R 19/005* (2013.01); *H04R 29/006* (2013.01); *H04R 2201/003* (2013.01); *H04R 2201/403* (2013.01); *H04R 2410/03* (2013.01)

(58) Field of Classification Search
USPC ..... 381/92, 94.7, 181, 94.6
See application file for complete search history.

(56) References Cited

OTHER PUBLICATIONS

David T. Martin et al: "A Micromachined Dual-Backplate Capacitive Microphone for Aeroacoustic Measurements", Journal of Microelectromechanical Systems, IEEE Service Center, US, vol. 16, No. 6, Dec. 1, 2007 (Dec. 1, 2007), pp. 1289-1302, XP011197840, ISSN: 1057-7157, DOI: 10.1109/JMEMS.2007.909234 paragraphs [II.F.], [IV.A.], [IV.B.]; figures 3, 4, 8, 9, 20.

Mohd-Yasin F et al: "Topical Review; Noise in MEMS", Measurement Science and Technology, IOP, Bristol, GB, vol. 21, No. 1, Jan. 1, 2010 (Jan. 1, 2010), p. 12001, XP020168476, ISSN: 0957-0233 paragraphs [0006], [0011]; figures 3, 8, 9.

Rombach P et al: "The first low voltage, low noise differential silicon microphone, technology development and measurement resultts", Sensors and Actuators A, Elsevier Sequoia S.A., Lausanne, CH, vol. 95, No. 2-3, Jan. 1, 2002 (Jan. 1, 2002), pp. 196-201, XP004377891, ISSN: 0924-4247, DOI: 10.1016/S0924-4247 (01) 00736-1, pargraph [0003]; figure 7.

Citakovic J et al: "A compact CMOS MEMS microphone with 66dB SNR", Solid-State Circuits Conference—Digest of Technical Papers, 2009. ISSCC 2009. IEEE International, IEEE, Piscataway, NJ, USA, Feb. 8, 2009 (Feb. 8, 2009), pp. 350-351, 351a, XP031742293, ISBN: 978-1-4244-3458-9 the whole document.

* cited by examiner

SYSTEM AND METHOD FOR ALL ELECTRICAL NOISE TESTING OF MEMS MICROPHONES IN PRODUCTION

RELATED APPLICATIONS

This application claims the benefit of U.S. Provisional Application No. 61/954,284, filed Mar. 17, 2014, the entire contents of which are incorporated herein by reference.

BACKGROUND

The present invention relates to the noise testing of high performance Micro-Electro-Mechanical Systems (MEMS) microphones in full-volume production without using acoustic isolation techniques. Acoustically testing MEMS microphones in production is costly, and current testing methods cannot cost effectively test 65 dB+ signal-to-noise ratio (SNR) microphones in production.

SUMMARY

One embodiment of the invention provides a system for testing total noise in a multi-membrane micro-electro-mechanical systems (MEMS) microphone. The system includes a MEMS microphone with two MEMS sensors, two MEMS biasing networks, a differential preamplifier and a processor. The processor, upon receiving a signal to enter test mode, will place the MEMS biasing networks into a reset mode, and adjust the bias voltage for the first MEMS sensor so it matches the polarity of the bias voltage of the second MEMS sensor. The processor then waits for the bias voltages to settle, and places the MEMS biasing networks into a sense mode. The total noise value for the MEMS microphone system can then be obtained. Once the total noise value has been obtained, the processor will exit the test mode upon receiving a second signal.

In some embodiments, the total noise value is obtained by measuring the output voltage of the differential preamplifier.

In some embodiments, the MEMS microphone and the processor are combined in a single package.

In some embodiments, the processor will receive an ambient noise level and an equivalent input noise level, and determine a desired rejection level from the ambient noise level and the equivalent input noise level. The processor then receives values for the same parameter from both MEMS sensors, and determines a mismatch percentage from the parameters. In some embodiments, the parameter is the sensitivity of the MEMS sensors. The processor then determines a mismatch effect from the mismatch value, and compares the mismatch effect to the desired rejection level. When the rejection level exceeds the mismatch effect, the processor takes a corrective action to lower the mismatch percentage. In some embodiments, this corrective action includes adjusting the bias voltages for one or both of the sensors.

In some embodiments, exiting the test mode includes placing the MEMS biasing networks into the reset mode, adjusting the bias voltages for the MEMS sensors so that they have opposite polarity, placing the first and second MEMS biasing networks into the sense mode, and resuming a normal operation mode.

Another embodiment of the invention provides a method for testing noise in a micro-electro-mechanical systems (MEMS) microphone system. The method uses a processor to place the MEMS biasing networks into a reset mode. The processor then adjusts the bias voltage for the first MEMS sensor so it matches the polarity of the bias voltage of the second MEMS sensor. The processor then waits for the bias voltages to settle, and places the MEMS biasing networks into a sense mode. The total noise value for the MEMS microphone system can then be obtained.

Other aspects of the invention will become apparent by consideration of the detailed description and accompanying drawings.

DETAILED DESCRIPTION

Figure 1:
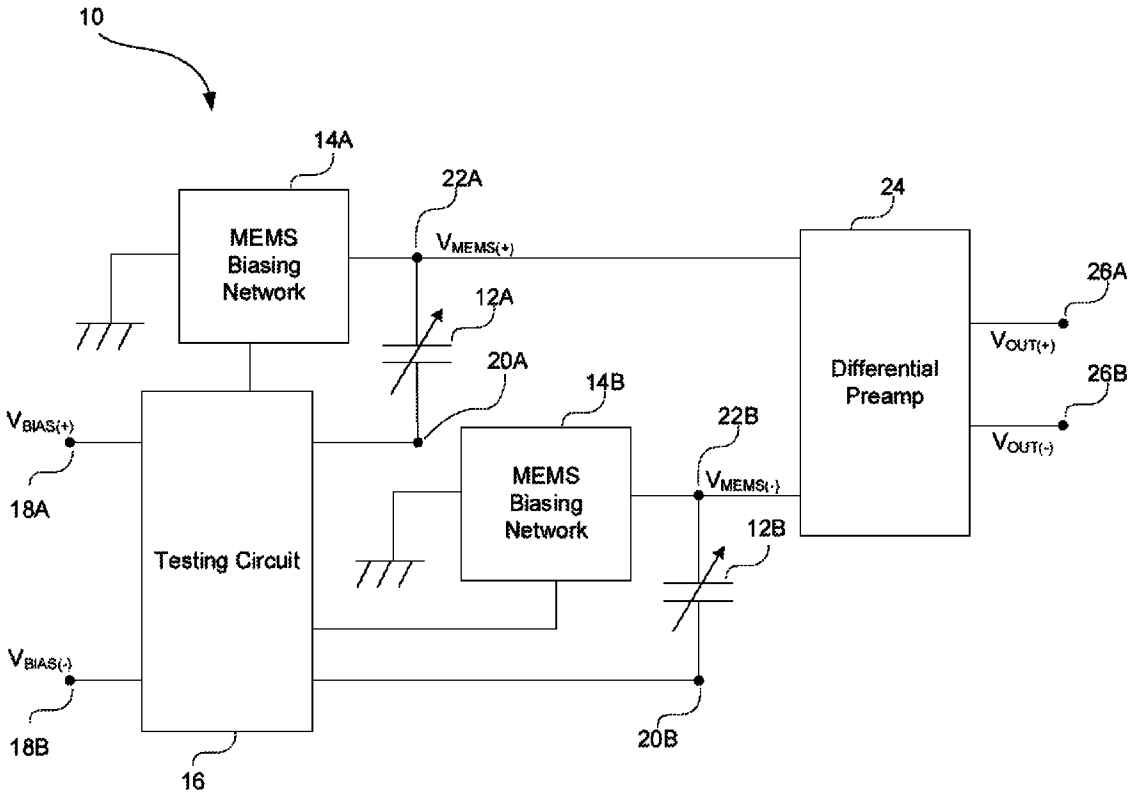
FIG. 1 is a schematic/block diagram representation of a dual-membrane MEMS microphone.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

It is also to be understood that, although the systems and methods described herein generally refer to dual-membrane MEMS microphones, they can be applied to multi-membrane MEMS microphones in general.

It should be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. For example, "control units," "controllers," "processors," and "circuits" described in the specification can include one or more processors, one or more memory modules including non-transitory computer-readable medium, one or more input/output interfaces, and various connections (e.g., a system bus) connecting the components.

Background noise (i.e., ambient noise) in a production environment can adversely affect a MEMS microphone testing system. Background noise includes, for example, traffic, conversations, movement, facility equipment, vibrations, etc., which are external to the MEMS microphone. The background noise can be consistent through the testing, process or can vary, sometimes rapidly. The sum of all the background noise can be measured in decibels (dBs) to determine an external sound pressure level (SPL).

A MEMS microphone uses a capacitive sensor to sense external acoustic noise sources, and transform those acoustic inputs into electrical outputs. Also included in the output is the individual mechanical and electrical noise of the MEMS microphone itself (self-noise). The portion of the output caused by the self-noise of a MEMS microphone can represented by an equivalent input noise (EIN), which is a theoretical external acoustic noise source, measured in dB, that would produce the same output as the self-noise. The dB of the EIN for a MEMS microphone is known from its manufacturing specification. If, during testing, the dB of the EIN for a MEMS microphone exceeds its specification level by more than an acceptable tolerance, that MEMS microphone fails the test. If the self-noise of a MEMS microphone can be accurately measured, the Signal-to-Noise-Ratio (SNR) for the MEMS microphone can be accurately determined.

However, because MEMS microphones have high SNR, measurement of the self-noise component of the output signal of the MEMS microphone can be washed out by external noise. Generally, during MEMS microphone testing, lowering the external noise SPL is desirable to achieve accurate testing of the MEMS microphones. This is usually accomplished through acoustic and vibration isolation for the microphone testing system, which can be expensive and may not effectively reduce the external noise SPL to required levels. Thus, embodiments of the present invention enable reliable self-noise testing of high performance MEMS microphones in fill volume production without acoustic and vibratory isolation considerations. The invention utilizes electrical inputs and measurements to test the self-noise level of a multi-membrane MEMS microphone. This allows cost effective testing of MEMS microphones that have high signal-to-noise ratios, such as those above 65 dB.

FIG. 1 shows a schematic/block diagram representation of a dual membrane MEMS microphone 10. The MEMS microphone 10 includes two MEMS sensors 12A, 12B, two MEMS biasing networks 14A, 14B, a testing circuit 16, two input bias voltage nodes 18A, 18B, two output bias voltage nodes 20A, 20B, two MEMS voltage nodes 22A, 22B a differential preamplifier 24, and two output voltage nodes 26A, 26B. The MEMS sensors 12A, 12B have matching electrical and mechanical characteristics, and are configured and positioned to move in phase with each other. The testing circuit 16 (e.g., a processor, an ASIC, etc.) is configurable to receive signals from external production and testing equipment, and is connected to the MEMS sensors 12A, 12B, and MEMS biasing networks 14A, 14B. The signals are applied to a specific pin, input, or node of the testing circuit 16 at specified voltage levels. Bias voltages are applied to the input bias voltage nodes 18A, 18B. The magnitude of the bias voltages is pre-determined based on manufacturing specifications of the MEMS microphone 10, the intended use of the MEMS microphone 10, and other factors. In normal operation of the MEMS microphone 10, input bias voltage node 18A is at a positive voltage and input bias voltage node 18B is at a negative voltage. During normal operation of the microphone, the testing circuit 16 is configured to pass through the bias voltages unaltered from the input bias voltage nodes 18A, 18B to the output bias voltage nodes 20A, 20B, respectively. During testing, the testing circuit 16 can alter the bias voltages it provides to MEMS sensors 12A, 12B at the output bias voltage nodes 20A, 20B, as appropriate to accomplish the testing. The MEMS bias networks 14A, 14B are connected to the testing circuit 16, and the MEMS voltage nodes 22A, 22B. The MEMS bias networks 14A, 14B are capable of switching between a low impedance state, also known as reset mode, where the bias voltages are applied to the MEMS sensors 12A, 12B to charge the capacitors, and a high impedance state, where the MEMS sensors 12A, 12B are isolated from the bias voltage. The MEMS sensors 12A, 12B operate when the MEMS bias networks 14A, 14B are in the high impedance state, also known as sense mode. The testing circuit 16 is configurable to switch the MEMS bias networks 14A, 14B between impedance states as appropriate to accomplish the testing. The output signals of the MEMS sensors 12A, 12B are present at the MEMS voltage nodes 22A, 22B, respectively, and are coupled to the differential preamplifier 24. The differential preamplifier 24 receives a differential input, created by the inversion in the polarities of the bias voltages present at the output bias voltage nodes 20A, 20B. The differential preamplifier 24 outputs the output signal of the MEMS microphone at the output voltage nodes 26A, 26B. The output signal can be read by external equipment during testing, or during normal operation of the MEMS microphone 10.

Figure 2:
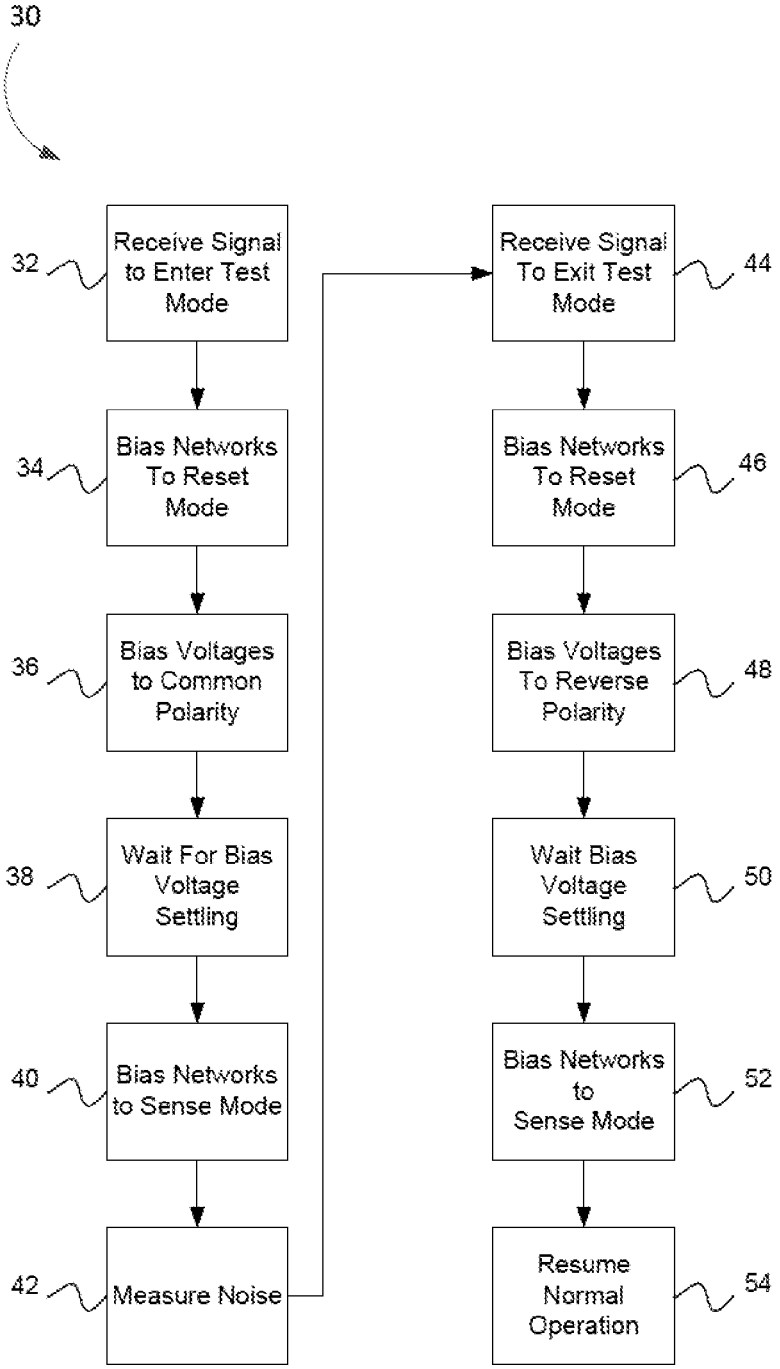
FIG. 2 is a block diagram of a method for determining the noise level of a dual-membrane MEMS microphone.

As illustrated in FIG. 2, MEMS microphone 10 can utilize a method 30 to determine the self-noise for the MEMS sensors 12A, 12B and the total noise for MEMS microphone 10. The testing circuit 16 receives a signal to enter a test mode, and enters test mode (at block 32), and places the MEMS bias networks 14A, 14B into reset mode (at block 34). The testing circuit then applies the full magnitude of the bias voltage to the MEMS sensors 12A, 12B in order to induce any failures (due to particles, poor oxide quality, silicon junction damage, and the like), and the testing circuit 16 adjusts the input bias voltages received from the input bias voltage nodes 18A, 18B to set the output bias voltage nodes 20A, 20B to a common polarity (at block 36). The testing circuit 16 then waits a short time (on the order of tens of milliseconds) for the bias voltages to settle (at block 38), and puts the MEMS bias networks 14A, 14B back into sense mode (at block 40).

In preferred embodiments, the differential preamplifier 24 has very good common mode rejection ratio (CMRR) (e.g., >40-60 dB), and thus it will operate to null, or reject, signals common to both of its inputs. The MEMS sensors 12A 12B have matching electrical and mechanical characteristics, and are configured and positioned to move in phase with each other, and thus they will produce the same output signals in response to same acoustic stimulus. However, during normal operation mode, the MEMS sensors 12A, 12B are biased with inverse polarities, and the output signals, though caused by the same acoustic inputs, are not rejected by the differential preamplifier 24, but are combined and passed through to the output voltage nodes 26A, 26B. Conversely, during test mode, both inputs to the differential preamplifier have a common polarity, so the differential preamplifier 24 rejects that portion of the output signals produced by the external acoustic inputs to the MEMS microphone 10. Only those portions of the outputs not common to both MEMS sensors 12A, 12B are passed through the differential preamplifier 24. Those outputs are caused by the self-noise of each the MEMS sensors 12A, 12B, and are combined by the differential preamplifier 24. The result is the total noise of the MEMS microphone 10, which is measured across output voltage nodes 26A, 26B (at block 42). Because the differential preamplifier 24 rejects the signals caused by external acoustic inputs, such as the ambient noise in the production and testing environment, it is possible to measure the total self-noise of the MEMS microphone 10 without acoustically isolating the microphone.

After the total noise measurement is taken, the testing circuit 16 receives a signal to exit the test mode (at block 44). The testing, circuit then places the MEMS bias networks 14A, 14B into reset mode (at block 34), and stops adjusting the bias voltages received from the input bias voltage nodes 18A, 18B, which returns the output bias voltage nodes 20A, 20B to inverse polarity (at block 48). The testing circuit 16 then waits a short time (on the order of tens of milliseconds) for the bias voltages to settle (at block 50), and puts the MEMS bias networks 14A, 14B back into sense mode (at block 52). Finally, the testing circuit 16 exits test mode and returns to nominal operating mode (at block 54).

As noted above, method 30 is performed assuming that the MEMS sensors 12A, 12B have matching electrical and mechanical characteristics. Normally, this is case with dual-membrane MEMS microphones. However, if the characteristics are mismatched, this can lower the capability of method 30 to detect the total-noise of MEMS microphone 10. The effects of mismatched characteristics can be more pronounced in environments with higher ambient noise SPL.

Figure 3:
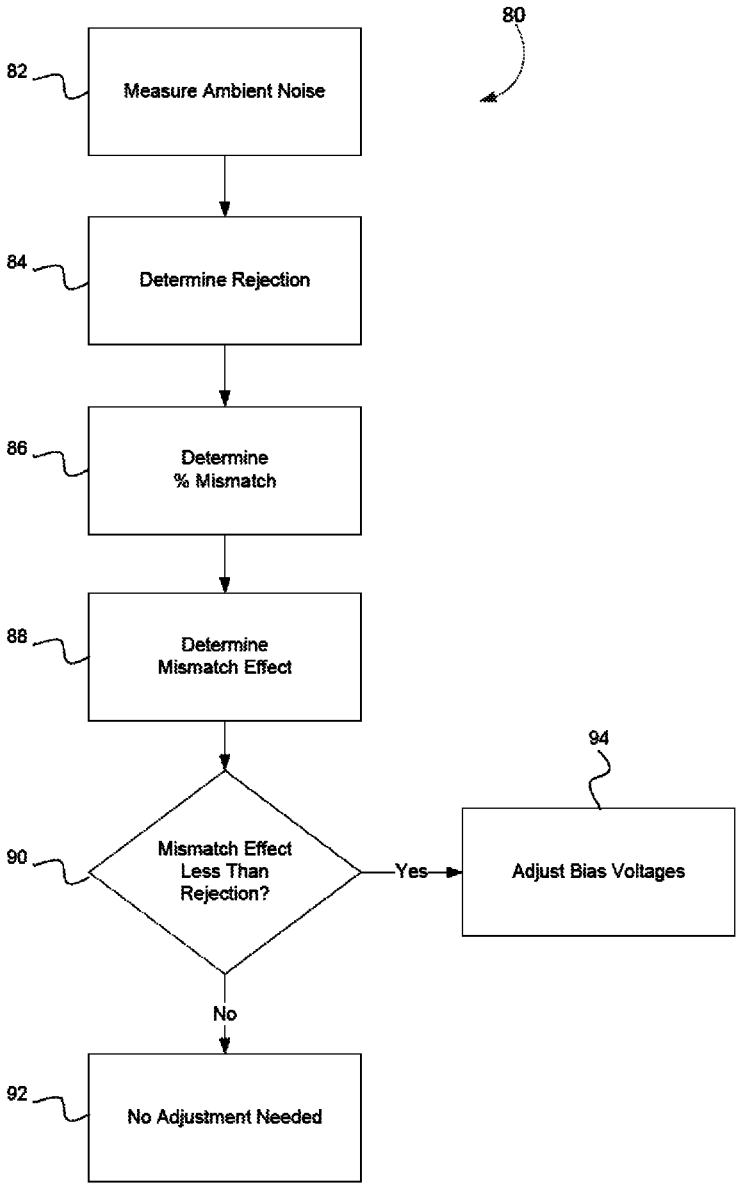
FIG. 3 is a block diagram of a method for matching dual-membrane MEMS microphones to improve the accuracy of noise testing.

As illustrated in FIG. 3, method 80 is used to detect and mitigate the effects of mismatching characteristics. Method 80 is performed by the testing circuit 16, by testing equipment external to MEMS microphone 10, or a combination of both. First, the SPL of the ambient noise, in dB, is measured (at block 82). Next, the amount of rejection required for accurate testing, is determined (at block 82). The rejection needed to test MEMS sensors 12A, 12B, in a given production environment is determined using the following equation:

$$(dB_{SPL}-dB_{EIN})+10\ dB=dB_{REJ}$$

where $dB_{SPL}$ is the sound pressure level of the ambient noise of the production environment, $dB_{EIN}$ is the specified EIN of the MEMS sensors 12A, 12B, and $dB_{REJ}$ is rejection level needed to test the MEMS sensors 12A, 12B in that production environment. Ideally, external noise should be rejected at least 10 dB below the internal noise of the MEMS microphone 10. This extra 10 dB of rejection is taken into account when determining $dB_{REJ}$.

The percentage of mismatch between the MEMS sensors 12A, 12B is then determined by comparing a characteristic, such as capacitance, or sensitivity, of the MEMS sensors (at block 86). The electrical and mechanical characteristics of the MEMS sensors 12A, 12B can be measured using traditional acoustic testing, or through the use of electrical self-testing. Regardless of measurement technique, the characteristics of each of the MEMS sensors 12A, 12B must be measured separately. This can be accomplished by lowering the bias voltage of the MEMS sensor not under test to zero, which disables it, and testing the other MEMS sensor.

The effect of the mismatch, in dB, is then determined (at block 88) using the following equation:

$$\log(Mismatch_{percent})\times 20=dB_{MIS}$$

where $Mismatch_{percent}$ is the percentage of mismatch, expressed as a decimal, and $dB_{MIS}$ is the effect of the mismatch, in dB (e.g., a 1% mismatch is a −40 dB effect: log(0.01)*20=−40 dB).

In the next step, $dB_{REJ}$ and $dB_{MIS}$ are compared (at block 90). If $dB_{MIS}$ is greater than $dB_{REJ}$, then no adjustment is necessary to account for the mismatch (at block 92), and test the MEMS microphone using method 30. However, if $dB_{MIS}$ is less than or equal to than $dB_{REJ}$, then the mismatch has to be reduced in order to increase the value of $dB_{MIS}$ until it is greater than $dB_{REJ}$. The testing circuit 16 accomplishes this by adjusting the bias voltage for one or both of the MEMS sensors 12A, 12B to achieve a change in the characteristic (at block 94). For example, if one sensor's sensitivity is lower than the other, the bias voltages can be adjusted up or down so the sensitivities match. When the match is achieved, testing circuit 16 can proceed with method 30, using the new bias voltages, rather than the default bias voltages, thus minimizing the mismatch and increasing the accuracy of the noise testing.

Thus, the invention provides, among other things, systems and methods for obtaining reliable total system noise (electrical plus acoustic/mechanical) and SNR values for a dual membrane MEMS microphone that are not limited by the common external acoustic and vibratory corruptions that exist on a production test floor. Various features and advantages of the invention are set forth in the following claims.

What is claimed is:

1. A micro-electro-mechanical systems (MEMS) microphone system, the system comprising:

a MEMS microphone including a first and second MEMS sensor, a first and second MEMS biasing network, a differential preamplifier; and a processor configured to activate a test mode upon receiving a signal to enter the test mode, the test mode including placing the first and second MEMS biasing networks into a reset mode by switching the first and second MEMS biasing networks to a low impedance state, adjusting a first bias voltage for the first MEMS sensor such that a first polarity the first bias voltage matches a second polarity of a second bias voltage of the second MEMS sensor, waiting for a settling time, placing the first and second MEMS biasing networks into a sense mode by switching the first and second MEMS biasing networks to a high impedance state, measuring an output of the differential preamplifier to obtain a total self-noise value for the MEMS microphone system, and exiting the test mode upon receiving a signal to exit the test mode.

2. The system of claim 1, wherein the MEMS microphone and the processor are combined in a single package.

3. The system of claim 1, wherein the processor is further configured to receive an ambient noise level, receive an equivalent input noise level, determine a desired rejection level from the ambient noise level and the equivalent input noise level, receive a first parameter of the first MEMS sensor, receive a second parameter the second MEMS sensor, determine a mismatch percentage from the first and second parameters, determine a mismatch effect from the mismatch value, compare the mismatch effect to the desired rejection level, and when the rejection level exceeds the mismatch effect, take a corrective action to lower the mismatch percentage.

4. The system of claim 3, wherein the first parameter is a first sensitivity of the first MEMS sensor, and the second parameter is a second sensitivity of the second MEMS sensor.

5. The system of claim 3, wherein the corrective action includes adjusting at least one of the first bias voltage and the second bias voltage.

6. The system of claim 1, wherein exiting the test mode includes placing the first and second MEMS biasing networks into the reset mode, adjusting the first bias voltage for the first MEMS sensor such that the first polarity of the first bias voltage is opposite the second polarity of the second bias voltage of the second MEMS sensor, placing the first and second MEMS biasing networks into the sense mode, and resuming a normal operation mode.

7. A method for testing noise in a micro-electro-mechanical systems (MEMS) microphone system including a processor, the method comprising:

placing, by the processor, a first MEMS biasing network and a second MEMS biasing network into a reset mode by switching the first and second MEMS biasing networks to a low impedance state, adjusting, by the processor, a first bias voltage for a first MEMS sensor such that a first polarity the first bias voltage matches a second polarity of a second bias voltage of a second MEMS sensor, waiting for a settling time, placing, by the processor, the first and second MEMS biasing networks into a sense mode by switching the first and second MEMS biasing networks to a high impedance state, measuring an output of the differential preamplifier to obtain a total self-noise value for the MEMS microphone system.

8. The method of claim 7, further comprising receiving, by the processor, an ambient noise level, receiving, by the processor, an equivalent input noise level, determining, by the processor, a desired rejection level from the ambient noise level and the equivalent input noise level, receiving, by the processor, a first parameter of the first MEMS sensor, receiving, by the processor, a second parameter the second MEMS sensor, determining, by the processor, a mismatch percentage from the first and second parameters, determining, by the processor, a mismatch effect from the mismatch value, comparing, by the processor, the mismatch effect to the desired rejection level, and when the rejection level exceeds the mismatch effect, taking, by the processor, a corrective action to lower the mismatch percentage.

9. The method of claim 8, wherein the first parameter is a first sensitivity of the first MEMS sensor, and the second parameter is a second sensitivity of the second MEMS sensor.

10. The method of claim 8, wherein the corrective action includes adjusting at least one of the first bias voltage and the second bias voltage.

11. The method of claim 7, further comprising placing, by the processor, the first and second MEMS biasing networks into the reset mode, adjusting, by the processor, the first bias voltage for the first MEMS sensor such that the first polarity of the first bias voltage is opposite the second polarity of the second bias voltage of the second MEMS sensor, and placing, by the processor, the first and second MEMS biasing networks into the sense mode.

* * * * *